US009762998B1

(12) United States Patent
Gore

(10) Patent No.: US 9,762,998 B1
(45) Date of Patent: Sep. 12, 2017

(54) LOUDSPEAKER WITH SOUND DISPERSION LENS

(71) Applicant: David Gore, Orange, CA (US)

(72) Inventor: David Gore, Orange, CA (US)

( * ) Notice: Subject to any disclaimer, the term of this patent is extended or adjusted under 35 U.S.C. 154(b) by 107 days.

(21) Appl. No.: 14/960,615

(22) Filed: Dec. 7, 2015

(51) Int. Cl.

| | |
|---|---|
| ***H04R 1/34*** | (2006.01) |
| *H04R 7/02* | (2006.01) |
| *H04R 7/12* | (2006.01) |
| *H04R 9/06* | (2006.01) |

(52) U.S. Cl.
CPC ..... *H04R 1/345* (2013.01); *H04R 1/34* (2013.01); *H04R 7/02* (2013.01); *H04R 7/12* (2013.01); *H04R 9/06* (2013.01); *H04R 2207/021* (2013.01)

(58) Field of Classification Search
CPC .... H04R 1/345; H04R 2207/021; H04R 9/02; H04R 7/00; H04R 7/02; H04R 7/04; H04R 7/06; H04R 7/12; H04R 7/14; H04R 7/122; H04R 7/125; H04R 7/127; H04R 31/003; H04R 2307/00; H04R 2307/021; H04R 2307/023; H04R 2307/025; H04R 2307/027; H04R 2307/029; H04R 1/34; H04R 9/06
USPC ..... 381/339, 396, 398
See application file for complete search history.

(56) References Cited

U.S. PATENT DOCUMENTS 3,735,336 A * 5/1973 Long ..... H04R 1/34 181/176
3,903,990 A * 9/1975 Tannaka ..... G10K 11/30 181/176
4,139,733 A * 2/1979 Falkenberg ..... H04R 7/12 181/166
4,164,631 A * 8/1979 Garner ..... H04R 1/345 181/176
4,321,434 A * 3/1982 Irie ..... H04R 7/14 181/172
4,776,428 A * 10/1988 Belisle ..... G10K 11/025 181/152
7,278,513 B2 * 10/2007 Brawley, Jr. ..... H04R 1/345 181/152
8,254,615 B2 * 8/2012 Schultz ..... H04R 1/345 381/339
2002/0146144 A1 * 10/2002 Arnstein ..... H04R 9/063 381/423
2007/0283677 A1 * 12/2007 Ohara ..... D02G 3/12 57/210
2008/0006476 A1 * 1/2008 Kling ..... G10K 11/26 181/176
2009/0067663 A1 * 3/2009 Ivey ..... F21V 7/0008 381/386

(Continued)

*Primary Examiner* — Davetta W Goins
*Assistant Examiner* — Oyesola C Ojo
(74) *Attorney, Agent, or Firm* — Ryder, Lu, Mazzeo & Konieczny LLC; Joseph M. Konieczny, Sr.; Gregory J. Gore

(57) ABSTRACT

A loudspeaker having a cylindrical sound-producing membrane includes an acoustic lens which radially surrounds the membrane. The membrane is composed of wire mesh formed into a cylinder. The cylindrical membrane is positioned on the magnet structure by an inner supporting cylindrical core column. Sound from the membrane is fractionally redirected by the lens which is centered along the axis of the membrane. The lens includes a plurality of radially disposed petals that reflect a portion of the sound. The base of the lens supports and mounts the loudspeaker magnet and driver assembly.

14 Claims, 3 Drawing Sheets

(56) References Cited

U.S. PATENT DOCUMENTS

2011/0026750 A1* 2/2011 Wang ..... B82Y 30/00
381/335

* cited by examiner

FIG. 3
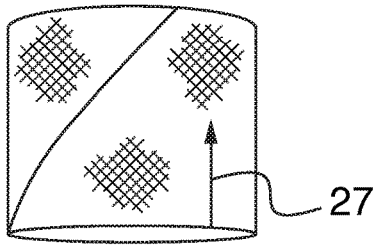
FIG. 4
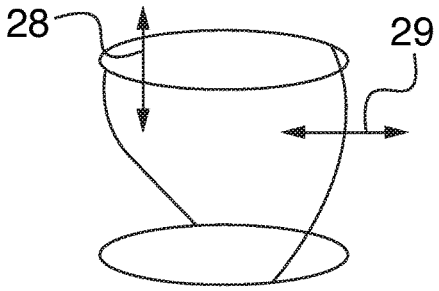
FIG. 5
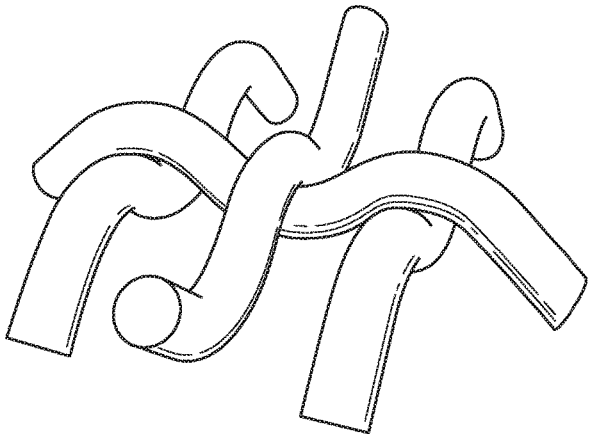
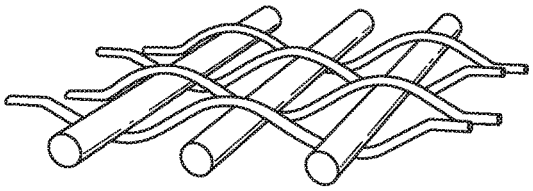
FIG. 6
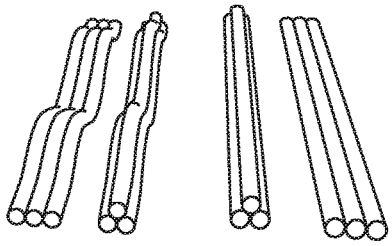
FIG. 7

LOUDSPEAKER WITH SOUND DISPERSION LENS

FIELD OF THE INVENTION

The present invention relates to high fidelity loudspeakers. More specifically it relates to high frequency tweeter loudspeakers which have sound dispersion structures.

BACKGROUND OF THE INVENTION

My previous U.S. Pat. No. 3,939,942, which is hereby incorporated by reference as though fully set forth herein, introduces a loudspeaker having a cylindrical sound-producing surface. The surface comprises a matrix of helically oriented fibers suspended in an elastomeric impregnate. The soft textile bundles of the membrane have restricted motion due to a large surface area that develops at the crossover points in the fine bundles such as fiberglass cloth which are then bonded by the sealant. While the device described in the '942 patent permits ease of manufacture, flexibility of the end product is greatly sacrificed. Consequently, relative to other technologies of the modern era this device is less efficient than desired.

Relevant prior technologies are disclosed in the following U.S. Pat. No 1,862,552 to Schlenker; U.S. Pat. No. 6,061,461 to Paddock; U.S. Pat. No. 4,138,733 to Falkenberg; U.S. Pat. No. 4,761,817 to Christie; U.S. Pat. No. 4,164,613 to Garner; U.S. Pat. No. 8,418,802 to Sterling; and U.S. Pat. No. 3,735,336 to Long.

SUMMARY OF THE INVENTION

The present invention greatly improves upon the device described in my previous '942 patent. The sound-producing diaphragm of the present invention comprises an array of formed wires which constitutes a cylindrical mesh membrane. The shape of the membrane is supported by the retained shape of the wires which are interwoven and then further formed into a closed cylindrical shape. Formation of the cylinder by bonding two virtually identical seamed halves of mesh sections provides balance in a preferred version. Overlay pieces may be employed to bond the edges of the identical section halves together along two radially symmetrical helical seams. The cylindrical membrane is positioned on the magnet structure by a core support column which extends from the magnet structure up through the center of the membrane cylinder. A voice coil is attached to the membrane cylinder around its bottom circular edge using a former at the driving end of the membrane adjacent the magnet structure. A former typically constitutes a thin strip of aluminum foil formed into a short cylinder. The opposite stationary retained top end of the mesh membrane is attached to a termination collar held by the top of the core column. The retainers typically constitute a terminus and associated washer.

The use of wires in contrast to the prior art are individually self-supporting because of their retained shape memory within the group without impregnation. Furthermore they do not deform during impregnation at the wire crossovers like fiberglass and similar carbon fiber or Kevlar products with hundreds or thousands of strands. This relatively enhanced deformability of the sealed wire mesh membrane permits miniaturization.

Sound from this membrane is fractionally redirected by a lens surrounding the axis of the cylinder thus maintaining virtually constant dispersion over the useable frequency range. The lens includes a plurality of radially disposed petals which reflect a portion of the sound to achieve better sound dispersion. The base of the lens structure also supports and mounts the driver assembly. Other features such as electrical terminal mounting holes are also contained in the lens structure.

The resulting mechanism of the present invention is best described as a motion transformer with a fixed area of vibratory action than as a transmission line where low frequencies are found near the terminal end and high frequencies concentrate near the driving source. The wire mesh has a relatively frequency independent central zone of maximum output equidistant between the voice coil and the terminal mounted end.

Thus the present device has many differences from the device disclosed in my previous patent U.S. Pat. No. 3,939,942. Other advantages and differences will follow from the foregoing explanation and the following drawings and description of the invention. The preferred embodiment of the invention will provide one of skill in the art with a full understanding of what has been invented. It will thereby be appreciated that the object of the invention to devise a high frequency loudspeaker with various advantages over the prior art has been achieved.

BRIEF DESCRIPTION OF THE DRAWINGS

FIGS. 3 and 4 are diagrams showing the basic operation of the sound producing mesh cylinder.

FIGS. 5 through 7 are perspective views of different cylinder mesh weaves.

DESCRIPTION OF THE PREFERRED EMBODIMENT

Figure 1:
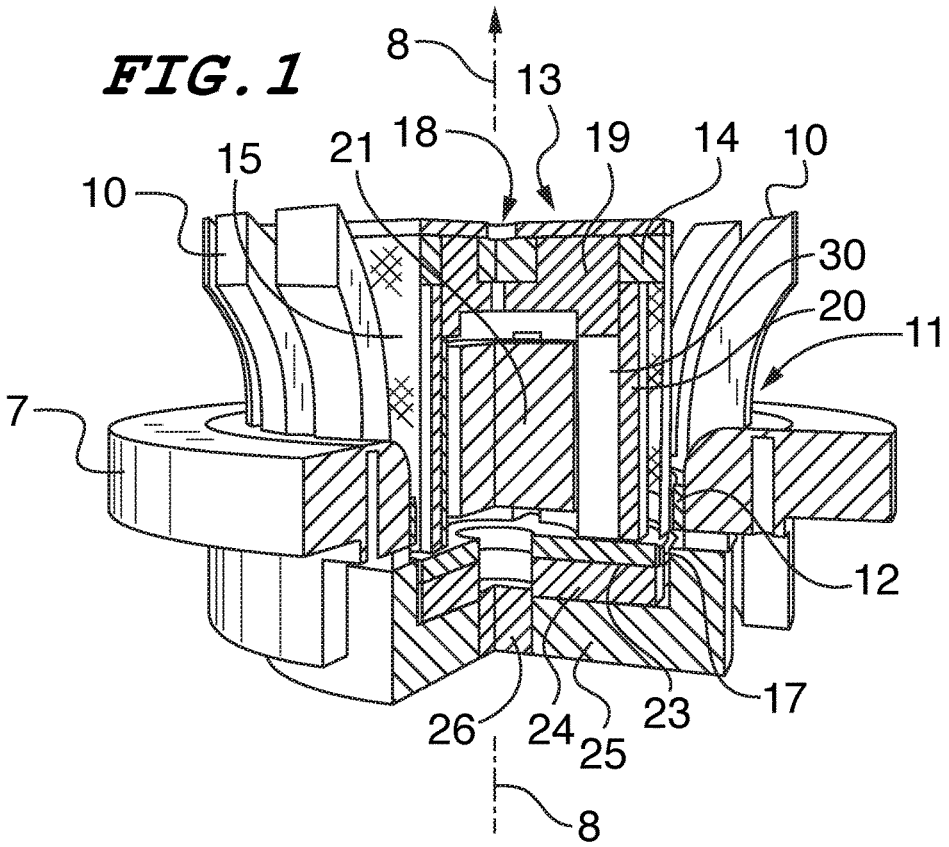
FIG. 1 is a dual axis perspective cutaway view.
Figure 2:
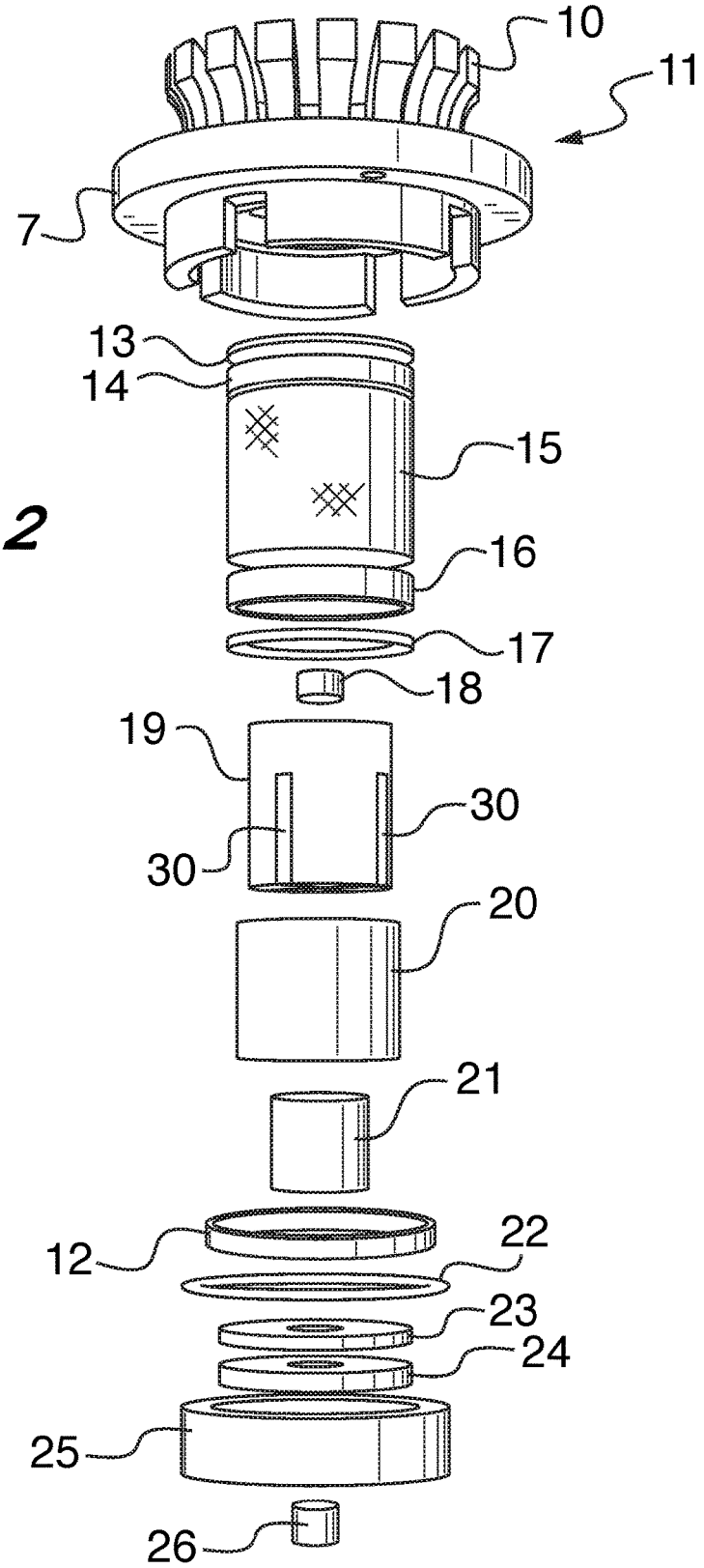
FIG. 2 is a perspective assembly view.

FIG. 1 is a cutaway view of the preferred embodiment of the loudspeaker invention and FIG. 2 is an assembly view thereof. Line 8 represents a cylindrical longitudinal axis of the device in the direction of motion of the voice coil 17. The axis line's arrow indicates the upward axial direction. As seen in these Figures the components of the device are radially symmetrical about the axis 8. Accordingly this drawing will give clear meaning to the terms; "axial", "axially", "upwardly", "top", "bottom", used herein.

Referring now to FIGS. 1 and 2, an acoustic lens 11 has a base 7 which unifies the loudspeaker assembly. A radial array of axially extending diffuser petals 10 is attached to the lens base to increase the sound dispersion at the highest frequencies. The sound-producing diaphragm 15 is a wire mesh membrane covered with a sealant and formed into a cylinder which is located about the longitudinal axis 8. A core column 19 is the main structural support for the membrane and extends coaxially up through the center of the membrane. The membrane is located coaxially about the support column and is suspended from its top end by an intermediate termination collar 14 attached to the top of the support column. The termination collar 14 is preferably composed of rubber and is capped by a washer 13. The base 7 of the lens 11 also holds a magnet structure which surrounds the bottom of the membrane 15. The magnet structure is an assembly united by an adhesive and is comprised of a magnet 24, a magnetic focusing structure 25, and a top plate 23. The circular bottom edge of the membrane is positioned by the core column 19 in a gap between magnet 24 and magnetic focusing structure 25. A former 16 composed of a thin cylinder of aluminum foil is affixed between the voice coil 17 and the membrane 15.

With continued reference to FIGS. 1 and 2, the lens 11 includes means at the base 7 for mounting the magnet and core column 19 structures described above. The bottom of core column 19 is affixed to the magnet assembly top plate 23 and is hollow, preferably including slots 30. It is surrounded on either side by acoustic damping means comprising two cylindrical felt layers 20 and 21. The outer felt layer 20 dampens the sound-producing membrane while the felt plug 21 inside the column absorbs the inwardly directed sound. The slots 30 provide a path for air pressure changes to be conducted through the felt layer 20 on the surface of the core column to the felt plug 21 in the interior which also acts to resistively dissipate acoustic energy. Gasket 22 retains the lead out wires from the voice coil and positions the magnet structure within the lens 11. An acoustic shim 12 creates a narrow annulus at the base of the membrane. A second magnet 18 is held in a countersink at the end of the core column in part to collect magnetic dust, attracting it away from the voice coil 17. Optional plug 26 and dust shielding magnet 18 complete the assembly. The petals 10 are equally spaced apart about 360 radial degrees. In the example shown the spaces or gaps between the individual petals are approximately one-half the width of each of the petals which are all substantially identical. The particular dimensions and proportions shown are to be only considered as exemplary and may vary. Shown here is an array of sixteen petals as exemplary of one embodiment of the invention however the individual petals have an arcuate longitudinal cross-section such that they flare outwardly toward their free ends. Unless otherwise specified all components whether indicated as "affixed", "attached" or otherwise are united by a suitable adhesive FIGS. 3 and 4 illustrate the basic operation of the sound-producing membrane of the invention. It is believed the highest frequency motion 27 is transmitted directly in the cylinder wall mesh as shown. This is because the assembly including the mesh sealant provides a shorter path of less resistance than bending the wires. Viscous properties in the sealant provide a lower resistance path. The viscous sealant thus becomes less flexible at higher frequencies but offers little change in the modulus of elasticity of the assembly statically. At low frequencies axial force 28 is converted to radial motion 29 by the bending of the wires in the mesh. It is further believed compressive and tensile forces on the assembly 27 can place stress in tension and compression depending on the direction of actuation along each wire (through the center line of the wire undulations) and along the curvature of the individual wires which regulate the deformation of the cylindrical membrane in accordance with the bending deformations which are also the result of motion 27. These compressive and tensile forces can be characterized by a resonance near the top of the band at high frequencies which enhances efficiency. Because of the angle of the wire array the internal volume increases as the cylindrical form is compressed and decreases as it is stretched. The bending motion compliance provides a resonant frequency typically an order of magnitude lower than the high frequency effect described above. The lower resonant frequency is typically predominantly a function of the internal acoustic compliance of the assembly. The force 27 acts on the bias ply of the wire mesh typically at 45 degrees to each wire.

FIGS. 5 through 7 depict various weaves of the wires which comprise the cylindrical membrane. In FIG. 5 we see a plain weave of formed wires that retains the shape of the assembly due to the residual retained shape of the wires. If the cylinder is formed from portions of a flat sheet the wire shape memory will flare the ends of the cylindrical shape which bends each wire unless the ends of each wire are affixed to the voice coil assembly and terminal assembly. Alternatively there may be variations in the weave where strands of a first degree of stiffness in one direction can be straight or almost straight crossed by woven strands of a second degree of stiffness in the other direction with a greater bend as seen in FIG. 6. The large wire can be composed of a few strands of smaller wire combined with the large wire in the asymmetrical weave. Undulating and straight variations are shown on FIG. 7. The undulations can vary and the shape of this bundle can vary by rearranging the strands. This can occur many times in a weave. This mesh is referred to as "Organza" in the fabric industry. These wires are typically a plastic such as polyester. In one direction in the organza the formed bundle can vary between in line or triangular. The use of an asymmetrical weave is believed to add a rotary reactive force on the voice coil. This can enhance the stability of the voice coil motion. The reduced or eliminated wire form undulation in one direction provides a more direct path for axial tension and compression in the wire. This can provide a desired modification in vibratory operation of the mesh. The other direction should be formed to accommodate the thicker wire and provide minimum thickness in the weave.

In one method of construction a flat section of wire mesh is cut into two trapezoidal sections. One section is bonded to a second identical section by being adhered to identical intermediate bonding strips which lie across the helical seams between the sections. The mesh has little dimensional stability prior to bonding the halves together so a rigid cylinder form is used. When wrapped around the cylinder form the final bond creates the cylindrical membrane. This method of producing the invention preferably incorporates the use of sacrificial liners to facilitate handling the mesh during manufacturing. The adhesive properties of the sealant require the use of non-adhesive liners such as wax paper. Dual liners can be used for part of the process. Once the sealed mesh is sandwiched between the liners the mesh is cut and then formed around the cylinder. Only after the assembly is complete and the now cylindrical mesh attached at both helical side seams and to the termination collar and former is it desirable to fully remove the liners. The final assembly has a flexible but stable shape due to the aggregate effect of individual shape memory of each wire and in the case of a formed originally flat construction the end attachments of each wire. Plastic wire which has functional elastic qualities within the bounds of its rigidity has been used. Metal wire performance is also advantageous. The wires flex together with very low sealant binding forces. While forming the wires directly into a cylinder shape by weaving could avoid assembling the cylinder from identical halves as described above, it does not appear to be presently practical.

Figure 8:
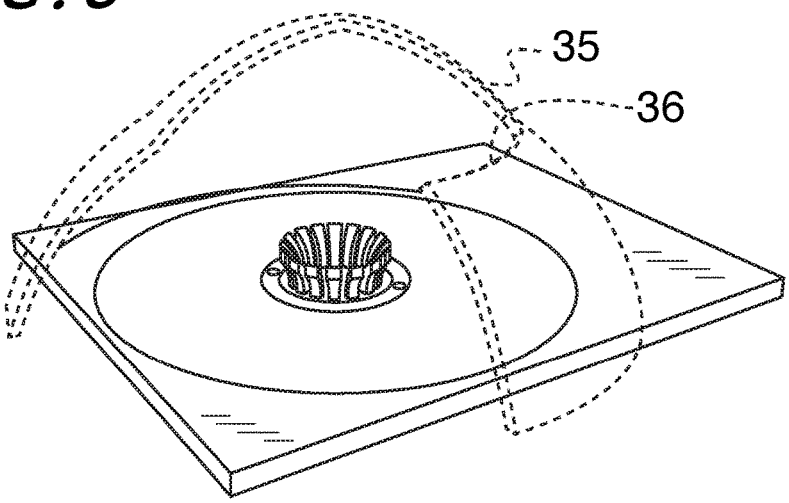
FIG. 8 is a perspective view diagrammatically showing sound dispersion patterns of the invention.

FIG. 8 shows how the lens alters the sound dispersion pattern of the membrane at high frequencies where the sound becomes directional. The output level and directionality without the lens is represented by pattern 34. The radial line of pattern 34 shows the original directional signal strength. The arc of pattern 34 shows the dispersion in a simplified sectional way. By employing the lens, high frequency sound emanating from the membrane radially outwardly and orthogonal to the membrane's axis either travels directly between the diffuser petals to the surrounding environment beyond a backside of the petals or is reflected by a front side of the petals. The output represented by 34 is there by fractionally dispersed by the lens into two attenuated patterns 35 and 36. The diagrammatic shell cut-away 36 represents the sound passing radially through the slots in the lens. The 35 shell cut-away represents the sound reflected by these lens petals axially. The combination approximates radiation into a hemisphere. The lens is shown mounted on a surface in a preferred manner. With a diameter of the cylindrical membrane of one inch a frequency range of approximately 2 to 20 kHz or more is obtained. Efficiency corresponds roughly to a conventional dome tweeter with the same electro motor. The net size above the mounting surface is slightly greater than a conventional dome tweeter but the dispersion is greater.

The foregoing is to be considered illustrative only of the principles and possible embodiments of the invention. Further, since numerous modifications and changes will readily occur to those skilled in the art, it is not desired to limit the invention to the exact construction and operation shown and described. Accordingly, suitable modifications and equivalents may be resorted to, all falling within the scope of the invention which shall be determined only by the following claims and their legal equivalents.

The invention claimed is:

1. A tweeter loudspeaker, comprising:

a cylindrical axis extending in an upward direction;

a core support column located about said axis and having a top and a bottom;

a sound-producing membrane connected to the top of the support column at a terminated top end of the membrane, said membrane located coaxially around the support column and energized by a voice coil at a bottom end of the membrane; and a sound-dispersing lens having a base affixed to the bottom of the support column, said lens comprising a plurality of axially extending diffuser petals located adjacent the membrane and positioned equally spaced apart about said axis through an arc of 360 degrees such that high frequency sound emanating from the membrane radially outwardly and orthogonal to the axis either travels directly between the petals to the surrounding environment beyond a backside of the petals or is reflected by a front side of the petals wherein said petals are interconnected at the base of the lens and each petal has an arcuate longitudinal cross-section which flares outwardly in an upward direction to a distal free end of each petal.

2. The device of claim 1 wherein the core support column extends from within the base of the lens upward through the center of the membrane to the top of said membrane where it is attached to the membrane by an intermediate collar.

3. The device of claim 1 wherein each of the petals is substantially identical.

4. The device of claim 3 wherein a width of each petal is approximately equal to one-half the distance between them.

5. The device of claim 4 wherein the membrane is substantially cylindrical.

6. The device of claim 5 wherein the membrane comprises a weave of wires bonded by a sealant.

7. The device of claim 6 wherein the membrane is composed of two identical trapezoidal sections bonded together along helical side seams.

8. The device of claim 7 wherein the weave of wires comprises wires of different sizes and degrees of stiffness.

9. The device of claim 1 wherein the support column is hollow and surrounded on either side by acoustic damping means located within the column and between the column and the membrane.

10. The device of claim 1 wherein the base of the lens surrounds the bottom of the membrane.

11. The device of claim 10 wherein the wires have self-supporting shape retention.

12. The device of claim 11 wherein the wires are composed of metal.

13. The device of claim 11 wherein the wires are composed of plastic.

14. The device of claim 1 wherein the magnet assembly comprises a magnet, a focusing structure and a top plate, and wherein the core support column is affixed to the top plate of the magnet assembly.

* * * * *